US011532871B2

(12) United States Patent
Zhou et al.

(10) Patent No.: US 11,532,871 B2
(45) Date of Patent: Dec. 20, 2022

(54) ANTENNA ASSEMBLY AND ELECTRONIC DEVICE

(71) Applicant: GUANGDONG OPPO MOBILE TELECOMMUNICATIONS CORP., LTD., Guangdong (CN)

(72) Inventors: Lin Zhou, Guangdong (CN); Liang Gu, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 37 days.

(21) Appl. No.: 17/144,867

(22) Filed: Jan. 8, 2021

(65) Prior Publication Data

US 2021/0126349 A1 Apr. 29, 2021

Related U.S. Application Data

(63) Continuation-in-part of application No. PCT/CN2019/087578, filed on May 20, 2019.

(30) Foreign Application Priority Data

Jul. 11, 2018 (CN) ..... 201810758289.1

(51) Int. Cl.
*H01Q 1/24* (2006.01)
*H01Q 5/00* (2015.01)
(Continued)

(52) U.S. Cl.
CPC ..... *H01Q 1/243* (2013.01); *H01Q 1/36* (2013.01); *H01Q 5/335* (2015.01); *H01Q 21/0006* (2013.01)

(58) Field of Classification Search
CPC ..... H01Q 1/24; H01Q 1/241; H01Q 1/243; H01Q 1/36; H01Q 5/00; H01Q 5/328; H01Q 5/335; H01Q 21/28
See application file for complete search history.

(56) References Cited

U.S. PATENT DOCUMENTS 7,639,185 B2 * 12/2009 Mei ..... H01Q 21/062 343/846
2008/0094282 A1 * 4/2008 Qin ..... H01Q 21/08 343/700 MS (Continued)

FOREIGN PATENT DOCUMENTS

CN 104953289 9/2015
CN 205104610 3/2016

(Continued)

OTHER PUBLICATIONS

SIPO, First Office Action for CN Application No. 201810758289.1, dated Jul. 26, 2019.

(Continued)

*Primary Examiner* — Thai Pham
(74) *Attorney, Agent, or Firm* — Hodgson Russ LLP

(57) ABSTRACT

An antenna assembly and an electronic device are provided. The antenna assembly includes a metal main body, a first metal connecting part, a second metal connecting part, and eight radiating elements disposed on the metal main body. The metal main body includes a first end, a second end opposite to the first end, a third end, and a fourth end opposite to the third end. The first metal connecting part and the second metal connecting part are respectively connected to the third end and the fourth end. The antenna assembly is configured to be operated as an 8×8 5G MIMO antenna system.

20 Claims, 8 Drawing Sheets

(51) Int. Cl.

| | |
|---|---|
| ***H01Q 5/335*** | (2015.01) |
| ***H01Q 1/36*** | (2006.01) |
| ***H01Q 21/00*** | (2006.01) |

(56) References Cited

U.S. PATENT DOCUMENTS

| | | | | |
|---|---|---|---|---|
| 2016/0013548 | A1 | 1/2016 | Park et al. | |
| 2016/0028157 | A1 | 1/2016 | Kim et al. | |
| 2016/0049736 | A1* | 2/2016 | Liu | H01Q 21/28 343/893 |
| 2016/0056545 | A1 | 2/2016 | Park et al. | |
| 2017/0351297 | A1 | 12/2017 | Kim et al. | |
| 2020/0243984 | A1* | 7/2020 | Ren | H01Q 5/378 |
| 2021/0318720 | A1* | 10/2021 | Lin | H01Q 1/44 |

FOREIGN PATENT DOCUMENTS

| | | | |
|---|---|---|---|
| CN | 205104610 U | * | 3/2016 |
| CN | 106505296 | | 3/2017 |
| CN | 106981725 | | 7/2017 |
| CN | 106992355 | | 7/2017 |
| CN | 107453056 | | 12/2017 |
| CN | 107919521 | | 4/2018 |
| CN | 108039564 | | 5/2018 |
| CN | 108039571 | | 5/2018 |
| CN | 108258425 | | 7/2018 |
| CN | 108736130 | | 11/2018 |
| KR | 101686784 | | 12/2016 |
| WO | 2018090295 | | 5/2018 |

OTHER PUBLICATIONS

WIPO, ISR for PCT/CN2019/087578, dated Aug. 5, 2019.
SIPO, Notification to Grant Patent Right for Invention for CN Application No. 201810758289.1, dated Oct. 31, 2019.
EPO, Extended European Search Report for EP Application No. 19833819.6, dated Jul. 22, 2021.

* cited by examiner

ANTENNA ASSEMBLY AND ELECTRONIC DEVICE

CROSS REFERENCE

This application is a continuation-in-part of International Application No. PCT/CN2019/087578, filed May 20, 2019, which claims priority to Chinese Patent Application No. 201810758289.1, filed Jul. 11, 2018, the entire disclosures of which are incorporated herein by reference.

TECHNICAL FIELD

The disclosure relates to the field of electronic device, and more particularly, to an antenna assembly and an electronic device.

BACKGROUND

With the development of communication technology, mobile electronic devices such as mobile phones and tablets are more and more widely used in people's daily life.

Antenna is a main electronic assembly to realize communication function of electronic devices and is also one of indispensable electronic components. At the same time, it becomes a trend to set multiple antennas to ensure good communication of electronic devices. However, at present, electronic devices have been equipped with two long-term evolution antennas, one is a position positioning antenna, and the other is a wireless fidelity antenna, thus the number of antennas is limited, which cannot meet the higher antenna demand.

SUMMARY

The present disclosure provides an antenna assembly and an electronic device to equip a number of antennas in the electronic device to meet higher requirements for antenna.

An antenna assembly includes a metal main body, a first metal connecting part, a second metal connecting part, a first radiating element, a second radiating element, a third radiating element, a fourth radiating element, a fifth radiating element, a sixth radiating element, a seventh radiating element, an eighth radiating element, wherein the metal main body is in a form of plate, the metal main body includes a first end, a second end opposite to the first end, a third end, and a fourth end opposite to the third end. The first metal connecting part and the second metal connecting part are respectively connected to the third end and the fourth end. The first radiating element, the second radiating element, the third radiating element and the fourth radiating element each are spaced from the metal main body. The first radiating element is connected to one end of the first metal connecting part towards the first end. The second radiating element is connected to the other end of the first metal connecting part towards the second end. The third radiating element is connected to one of the second metal connecting part towards the first end. The fourth radiating element is disposed on the other end of the second metal connecting part towards the second end. The fifth radiating element, the sixth radiating element, the seventh radiating element, and the eighth radiating element are spaced from the metal main body. The fifth radiating element and the sixth radiating element are disposed on the second end. The seventh radiating element is disposed on the first end. The eighth radiating element is disposed on the first end or the second end, wherein the antenna assembly is configured to be operated as an 8×8 5G MIMO antenna system.

In one embodiment, the antenna assembly is configured to support a dual-frequency band, the dual-frequency band comprises both 3.3 GHz to 3.6 GHz channels and 4.8 GHz to 5 GHz channels.

In one embodiment, at least one of the sixth radiating element and the seventh radiating element is multiplexed to support both 4G frequency band and 5G frequency band, the first radiating element, the second radiating element, the third radiating element, the fourth radiating element, the fifth radiating element, and the eighth radiating element are configured to support 5G frequency band only.

In one embodiment, the eighth radiating element is disposed on the first end, the fifth radiating element is disposed on one side of the sixth radiating element towards the third end, the seventh radiating element is disposed on one side of the eighth radiating element towards the third end.

In one embodiment, the antenna assembly further includes a third metal connecting part, the third metal connecting part is connected to the fourth end and located at one side of the second metal connecting part towards the first end, the third metal connecting part is connected between the metal main body and the eighth radiating element.

In one embodiment, the eighth radiating element comprises a first part and a second part connected with each other, the first part is located at the fourth end and connected to the third metal connecting part, the second part is located at the first end.

In one embodiment, a first gap is formed between the eighth radiating element and the third radiating element.

In one embodiment, the seventh radiating element includes a third part and a fourth part connected with each other, the third part is located at the first end, the fourth part is located at the third end.

In one embodiment, a second gap is formed between the seventh radiating element and the eighth radiating element, and a third gap is formed between the seventh radiating element and the first radiating element.

In one embodiment, the sixth radiating element includes a fifth part and a sixth part connected with each other, the fifth part is located at the second end, the sixth part is located at the fourth end.

In one embodiment, a fourth gap is formed between the sixth radiating element and the fourth radiating element, and a fifth gap is formed between the sixth radiating element and the fifth radiating element.

In one embodiment, the eighth radiating element is disposed on the second end, the fifth radiating element is disposed on one side of the sixth radiating element towards the third end, the eighth radiating element is located at one side of the sixth radiating element towards the fourth end.

In one embodiment, a sixth gap is formed between the fifth radiating element and the sixth radiating element, and a seventh gap is formed between the seventh radiating element and the sixth radiating element.

In one embodiment, the sixth radiating element extends along a direction from the fourth end to the third end.

In one embodiment, the eighth radiating element includes a seventh part and an eighth part connected with each other, the seventh part is located at the second end, the eighth part is located at the fourth end.

In one embodiment, an eighth gap is formed between the eighth radiating element and the fourth radiating element.

In one embodiment, the antenna assembly further includes a fourth metal connecting part, the fourth metal connecting part is connected to the second end and located at one side of the second metal connecting part towards the first end, the fourth metal connecting part is connected between the metal main body and the seventh radiating element.

In one embodiment, the seventh radiating element includes sequentially connected ninth part, a tenth part, and an eleventh part, the ninth part is located at the third end, the tenth part is located at the first end, the eleventh part is located at the fourth end.

In one embodiment, a ninth gap is formed between the seventh radiating element and the first radiating element, and a tenth gap is formed between the seventh radiating element and the third radiating element.

In one embodiment, an eleventh gap is formed between the fifth radiating element and the second radiating element.

An antenna assembly includes a metal main body, a first metal connecting part, a second metal connecting part, a first radiating element, a second radiating element, a third radiating element, a fourth radiating element, a fifth radiating element, a sixth radiating element, a seventh radiating element, an eighth radiating element, wherein the metal main body is in a form of plate, the metal main body includes a first end, a second end opposite to the first end, a third end, and a fourth end opposite to the third end. The first metal connecting part and the second metal connecting part are respectively connected to the third end and the fourth end. The first radiating element, the second radiating element, the third radiating element and the fourth radiating element each are spaced from the metal main body. The first radiating element is connected to one end of the first metal connecting part towards the first end. The second radiating element is connected to the other end of the first metal connecting part towards the second end. The third radiating element is connected to one of the second metal connecting part towards the first end. The fourth radiating element is disposed on the other end of the second metal connecting part towards the second end. The fifth radiating element, the sixth radiating element, the seventh radiating element, and the eighth radiating element are spaced from the metal main body. The fifth radiating element and the sixth radiating element are disposed on the second end. The seventh radiating element is disposed on the first end. The eighth radiating element is disposed on the metal main body, wherein the antenna assembly is configured to be operated as an 8×8 5G MIMO antenna system.

An electronic device includes an antenna assembly described above, and a circuit board. The antenna assembly is configured to be operated as an 8×8 5G MIMO antenna system. The circuit board is provided with a number of feeds, a number of matching circuits, and a number of frequency band switching modules. The first radiating element, the second radiating element, the third radiating element, the fourth radiating element, the fifth radiating element, the sixth radiating element, the seventh radiating element, and the eighth radiating element are respectively connected to the feeds through at least one of the matching circuits and respectively connected to the ground through at least one of the frequency band switching modules.

In one embodiment, each of the first radiating element, the second radiating element, the third radiating element, the fourth radiating element, the fifth radiating element, the sixth radiating element, the seventh radiating element, and the eighth radiating element is respectively connected to one of the plurality of the frequency band switching modules, each frequency band switching modules is configured to achieve switching between two bands of 3.3 GHz to 3.6 GHz and 4.8 GHz to 5 GHz.

The antenna assembly and electronic device provided by the present disclosure includes a metal main body, a first metal connecting part, a second metal connecting part, and eight metal radiating elements arranged on the metal main body. The metal main body includes a first end, a second end opposite to the first end, a third end, and a fourth end opposite to the third end. The first metal connecting part and the second connecting part are respectively connected to the third end and the fourth end of the metal main body. The radiating elements are all spaced from the metal main body. The first radiating element and the second radiating element are connected to the first metal connecting part. The third radiating element and the fourth radiating element are disposed on the second metal connecting part. The fifth radiating element and the sixth radiating element are disposed on the second end. The seventh radiating element is disposed on the first end. The eighth radiating element is disposed on the first end or the second end. The radiating elements are connected to the feeds through the matching circuit board of the electronic device to transmit and receive signals to form an 8×8 5G MIMO (multiple-input multiple-output) antenna, so that the electronic device is provided with multiple antennas to meet high antenna requirements.

BRIEF DESCRIPTION OF THE DRAWINGS

In order to explain the embodiment of the present disclosure, the following description to the drawings used in the embodiments is briefly introduces. It is obvious that the drawings described below are only some of the examples of the present disclosure. Skilled person in the art could obtain other drawings according to these drawings without creative work.

and

Figure 10:
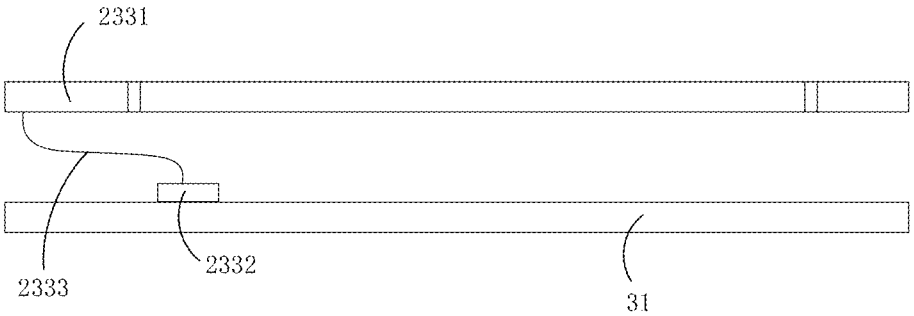

FIG. 10 is a structural diagram showing combination of an antenna assembly and a circuit board according to the present disclosure.

DETAILED DESCRIPTION OF PREFERRED EMBODIMENTS

An electronic device, includes:

an antenna assembly as stated above; and a circuit board, wherein the circuit board is provided with a plurality of feeds, a plurality of matching circuits, and a plurality of frequency band switching modules, the first radiating element, the second radiating element, the third radiating element, the fourth radiating element, the fifth radiating element, the sixth radiating element, the seventh radiating element, and the eighth radiating element are respectively connected to the feeds through at least one of the plurality of the matching circuits, and respectively connected to the ground trough at least one of the plurality of frequency band switching modules.

In the electronic device provided by the present disclosure, the eighth radiating element is disposed on the first end, the fifth radiating element is disposed on one side of the sixth radiating element towards the third end, the seventh radiating element is disposed on one side of the eighth radiating element towards the third end.

Figure 1:
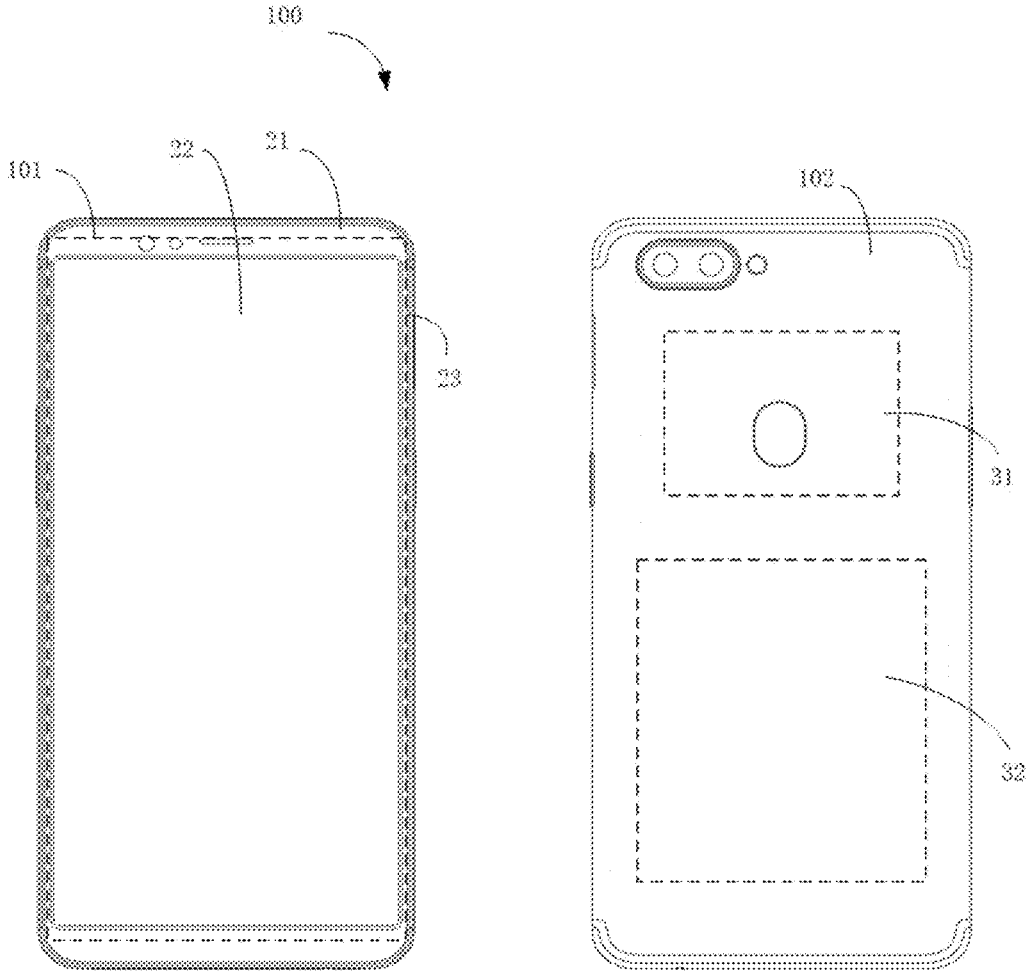
FIG. 1 is a structural perspective of an electronic device according to an embodiment of the present disclosure.

An electronic device 100 is illustrated in FIG. 1.

The electronic device 100 includes a front frame 101 and a back cover 102. The front frame 101 may include a protective cover 21, a display screen, and so on. The front frame 101 and the back cover 102 jointly enclose an accommodating space for arranging other components, such as an antenna assembly 23, a circuit board 31, a battery 32, and so on.

In some embodiment, the front frame 101 and the back cover 102 may be metal shell. It should be noted that the materials of the front frame 101 and the back cover 102 are not limited to this, and other materials are also available, such as, the front frame 101 and the back cover 102 may be made of plastic and metal or made of plastic.

The protective cover 21 may be glass cover, sapphire cover, plastic cover, etc., providing protection on the display 22 to kept from dust, moisture, or oil stains, to avoid external corrosion, and to reduce impact from the external to avoid broken.

The protective cover 21 may include a display area and a non-display area. The display area is transparent and corresponds to a light emitting surface of the display 22. The non-display area is non-transparent to mask inner structure of the electronic device. The non-display area may provide openings for sound and light transmitting.

It is noted that the electronic device 100 may also be a full screen electronic device without the non-display area.

Figure 2:
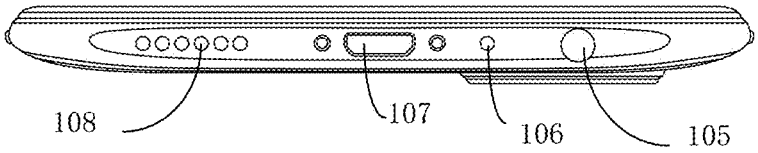
FIG. 2 is a side view of the electronic device according to an embodiment of the present disclosure.

As shown in FIG. 2, the electronic device 100 may provide a headphone hole 105, a microphone hole 106, a speaker hole 108, and a universal serial bus interface hole 107, all of which are through holes.

The antenna assembly 23 is arranged inside the accommodating space, to support the whole electronic device 100 as well. In an embodiment, one side of the antenna assembly 23 faces the front frame 101 to dispose the display 22, and the other side of the antenna assembly 23 faces the back cover 102 to dispose the circuit board 31 and the battery 32.

Figure 3:
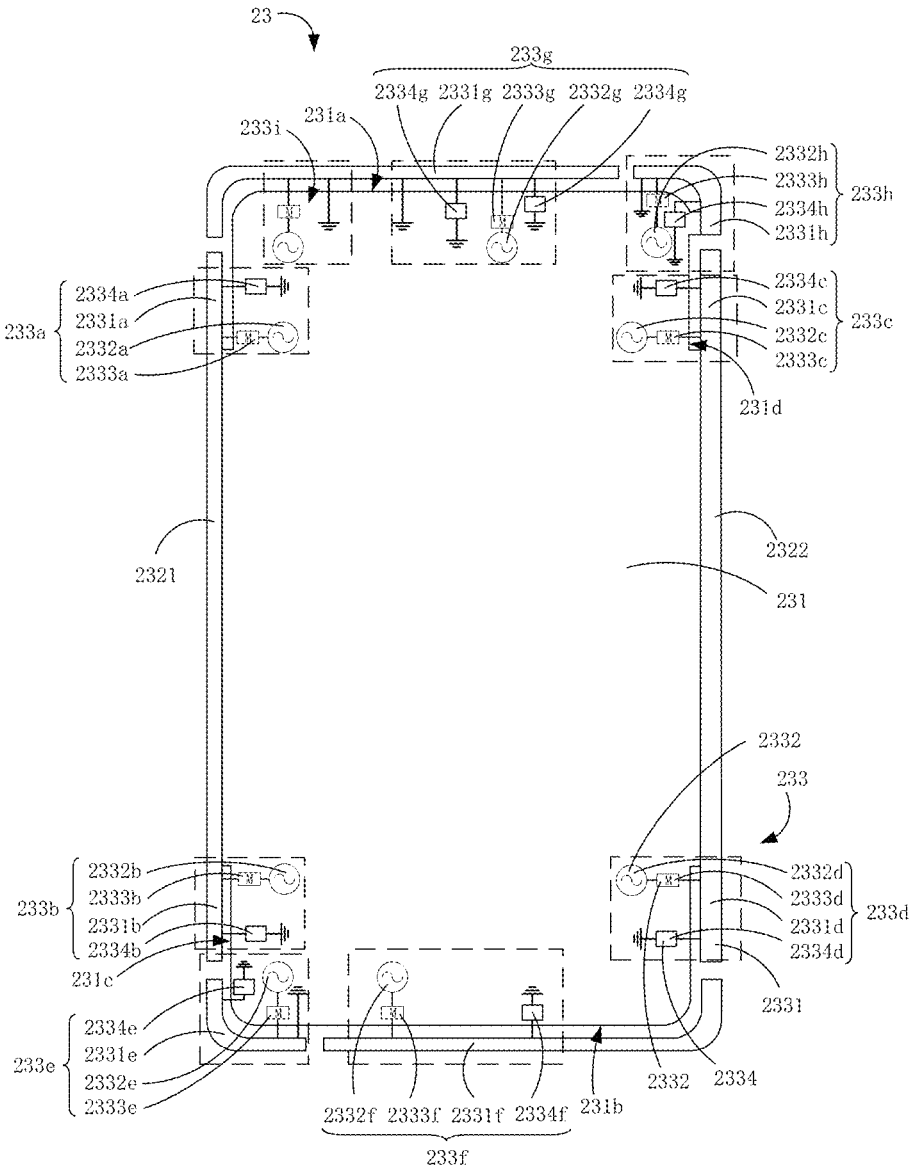
FIG. 3 is a structural diagram of a first embodiment according to the present disclosure.

As shown in FIG. 3, the antenna assembly 23 includes a metal main body 231, a first metal connecting part 2321, a second metal connecting part 2322 and eight antenna structure 233. In the present disclosure, it is understood that the "first", "second" etc. are used only for descriptive purpose and cannot be understood as indicating or implying relative importance or indicting the number of technical features indicated. Thus the features qualified as "first" and "second" may include one or more feature expressly or implicitly. In the embodiment, "multiple" means two or more, unless otherwise expressly specified.

The metal main body 231 is in a form of plate. The metal main body 231 may be made of magnesium alloy.

In one embodiment, the metal main body 231 includes a first end 231*a*, a second end 231*b*, a third end 231*c*, and a fourth end 231*d*. The first end 231*a* and the second end 231*b* are oppositely disposed. The third end 231*c* and the fourth end 231*d* are oppositely disposed.

The first metal connecting part 2321 is connected to the third end 231*c*. The second metal connecting part 2322 is connected to the fourth end 231*d*. In the present disclosure, it is stated that, unless otherwise expressly defined, the term "connecting" should be understood broadly. For example, it may mean a fixed connection, a removable connection, or an all-in-one connection, a mechanical connection, an electrical connection, or a communicating connection, a direct connection, an indirect connection through other means, an internal connection between two parts, or an interaction between two parts. The person skilled in the art could understand the specified meaning in the present disclosure.

Each antenna structure 233 includes a radiating element 231, at least one feed 2332, at least one matching circuit 2333, and at least one frequency band switching module 2334. The radiating element 231 is connected to one feed 2332 through the at least one matching circuit 2333, and respectively connected to the ground through the at least one frequency band switching module 2334. The first radiating element, the second radiating element, the third radiating element, the fourth radiating element, the fifth radiating element, the sixth radiating element, the seventh radiating element, and the eighth radiating element are respectively connected to the one or more feeds through the at least one matching circuit, and respectively connected to the ground through the at least one frequency band switching module.

The frequency band switching module 2334 is arranged according to a frequency band to be switched. For example, the frequency band switching module 2334 may include a single-pole double throw switch, a first capacitor and a second capacitor, where capacitance values of the first capacitor and the second capacitor are different. An input terminal of the single-pole double throw switch is connected to a frequency band switching point of the antenna structure 233. Two output terminals of the single-pole double throw switch are respectively connected to the ground through the first capacitor and the second capacitor. It is understood that one or two of the first capacitor and the second capacitor may be replaced by one or two inductors, or a LC circuit (i.e., a circuit in which inductors and capacitors are parallel connected). Where, capacitance values of the first capacitor and the second capacitor are determined according to the frequency bands of the antenna structure 233. As the same, values of the inductors and the LC circuit may be also determined according to the frequency bands of the antenna structure 233. The first capacitor and the second capacitor may be replaced by an inductor and a LC circuit. The frequency band switching module 2334 is used to achieve switching between two bands of 5G N78 band (3.3 GHz to 3.6 GHz) and 5G N79 band (4.8 GHz to 5 GHz).

The eighth antenna structure 233 includes a first antenna structure 233*a*, a second antenna structure 233*b*, a third antenna structure 233*c*, a fourth antenna structure 233*d*, a fifth antenna structure 233*e*, a sixth antenna structure 233*f*, a seventh antenna structure 233*g*, and an eighth antenna structure 233*h*.

The first antenna structure 233*a* includes a first radiating element 2331*a*, a first feed 2332*a*, a first matching circuit 2333*a*, and a first frequency band switching module 2334*a*. The first radiating element 2331*a* is connected to the first feed 2332*a* through the first matching circuit 2333*a* and connected to the ground through the first frequency band switching module 2334*a*.

The second antenna structure 233*b* includes a second radiating element 2331*b*, a second feed 2332*b*, a second matching circuit 2333*b*, and a second frequency band switching module 2334*b*. The second radiating element

2331*b* is connected to the second feed 2332*b* through the second matching circuit 2333*b* and connected to the ground through the second frequency band switching module 2334*b*.

The third antenna structure 233*c* includes a third radiating element 2331*c*, a third feed 2332*c*, a third matching circuit 2333*c*, and a third frequency band switching module 2334*c*. The third radiating element 2331*c* is connected to the third feed 2332*c* through the third matching circuit 2333*c* and connected to the ground through the third frequency band switching module 2334*c*.

The fourth antenna structure 233*d* includes a fourth radiating element 2331*d*, a fourth feed 2332*d*, a fourth matching circuit 2333*d*, and a fourth frequency band switching module 2334*d*. The fourth radiating element 2331*d* is connected to the fourth feed 2332*d* through the fourth matching circuit 2333*d* and connected to the ground through the fourth frequency band switching module 2334*d*.

The first radiating element 2331*a*, the second radiating element 2331*b*, the third radiating element 2331*c*, and the fourth radiating element 2331*d* are spaced from the metal main body 231. That is, there is space between each of the first radiating element 2331*a*, the second radiating element 2331*b*, the third radiating element 2331*c*, the fourth radiating element 2331*d* and the metal main body 231. The space is available for filling non-conducting material to increase connection strength between each of the first radiating element 2331*a*, the second radiating element 2331*b*, the third radiating element 2331*c*, the fourth radiating element 2331*d* and the metal main body 231 to enhance the whole strength of every antenna structure. The first radiating element 2331*a* is connected to one end of the first metal connecting part 2321 towards the first end 231*a*. The second radiating element 2331*b* is connected to the other end of the first metal connecting part 2321 towards the second end 231*b*. The first radiating element 2331*a* extends toward the first end 231*a* from the first metal connecting part 2321. The second radiating element 2331*b* extends toward the second end 231*b* from the first metal connecting part 2321. The third radiating element 2331*c* is disposed on one end of the second metal connecting part 2322 towards the second end 231*b*. The fourth radiating element 2331*d* is disposed on the other end of the second metal connecting part 2322 towards the second end 231*b*. The third radiating element 2331*c* extends towards the first end 231*a* from the second metal connecting part 2322. The fourth radiating element 2331*d* extends towards the second end 231*b* from the second metal connecting part 2322.

The fifth antenna structure 233*e* includes a fifth radiating element 2331*e*, a fifth feed 2332*e*, a fifth matching circuit 2333*e*, and a fifth frequency band switching module 2334*e*. The fifth radiating element 2331*e* is connected to the fifth feed 2332*e* through the fifth matching circuit 2333*e* and connected to the ground through the fifth frequency band switching module 2334*e*.

The sixth antenna structure 233*f* includes a sixth radiating element 2331*f*, a sixth feed 2332*f*, a sixth matching circuit 2333*f*, and a sixth frequency band switching module 2334*f* The sixth radiating element 2331*f* is connected to the sixth feed 2332*f* through the sixth matching circuit 2333*f* and connected to the ground through the sixth frequency band switching module 2334*f*.

The seventh antenna structure 233*g* includes a seventh radiating element 2331*g*, a seventh feed 2332*g*, a seventh matching circuit 2333*g*, and a seventh frequency band switching module 2334*g*. The seventh radiating element 2331*g* is connected to the seventh feed 2332*g* through the seventh matching circuit 2333*g* and connected to the ground through the seventh frequency band switching module 2334*g*.

The eighth antenna structure 233*h* includes an eighth radiating element 2331*h*, an eighth feed 2332*h*, an eighth matching circuit 2333*h*, and an eighth frequency band switching module 2334*h*. The eighth radiating element 2331*h* is connected to the eighth feed 2332*h* through the eighth matching circuit 2333*h* and connected to the ground through the eighth frequency band switching module 2334*h*.

Each of the first antenna structure 233*a*, the second antenna structure 233*b*, the third antenna structure 233*c*, the fourth antenna structure 233*d*, the fifth antenna structure 233*e*, the sixth antenna structure 233*f*, the seventh antenna structure 233*g*, and the eighth antenna structure 233*h* may be taken as a 5G antenna, thereby forming an 8×8 5G MIMO (multiple-input multiple-output) antenna. In one embodiment, each of these antenna structures may achieve dual-frequency bands communicating through a switch.

One side of the seventh radiating element 2331*g* near the third end 231*c* may be further arranged with an assisting antenna structure 233*i*, which is used to transmit short distance antenna signals and/or positioning signals. The short distance antenna signals may be Wireless-Fidelity (Wireless-Fidelity or WIFI) signals, Blue tooth signals. The positioning signals may be GPS signals.

At least one of the sixth radiating element 2331*f* and the seventh radiating element 2331*g* may be a radiating element of 4G long term evolution (LTE) antenna, that is, capable of transmitting and/or receiving 4G LTE signals. At least one of the sixth radiating element 2331*f* and the seventh radiating element 2331*g* may further transmit and/or receive 5G signals, thus at least one of the sixth radiating element 2331*f* and the seventh radiating element 2331*g* is worked as a radiating element of a 4G LTE antenna, and is multiplexed to be a radiating element of a 5G antenna.

In one embodiment, the sixth radiating element 2331*f* supports both 4G frequency band and 5G frequency band. The other seven radiating elements support 5G frequency band only. The sixth radiating element 2331*f* and the other seven radiating elements are used to form an 8×8 5G MIMO antenna.

In one embodiment, the seventh radiating element 2331*g* supports both 4G frequency band and 5G frequency band. The other seven radiating elements support 5G frequency band only. The seventh radiating element 2331*g* and the other seven radiating elements are used to form an 8×8 5G MIMO antenna.

In one embodiment, the sixth radiating element 2331*f* and the seventh radiating element 2331*g* both support 4G frequency band and 5G frequency band. The other six radiating elements support 5G frequency band only. The eight radiating elements are used to form an 8×8 5G MIMO antenna.

At least one radiating element of the sixth radiating element 2331*f* and the seventh radiating element 2331*g*, supporting 4G frequency band, is multiplexed to support 5G frequency band, thus one or two existing radiating elements of 4G LTE antenna in an electronic device may be used without adding one or two extra radiating elements specially used to support 5G frequency band. The limited inner space of an electronic device for disposing radiating elements is thus fully used. In this way, space utilization of an electronic device is increased and 5G communication performance is improved as well.

The fifth radiating element 2331*e*, the sixth radiating element 2331*f*, the seventh radiating element 2331*g*, and the eighth radiating element 2331*h* are spaced from the metal main body 231.

The fifth radiating element 2331*e* and the sixth radiating element 2331*f* are both disposed on the second end 231*b*. The seventh radiating element 2331*g* is disposed on the first end 231*a*. The eighth radiating element is disposed on the first end 231*a* or the second end 231*b*.

Figure 4:
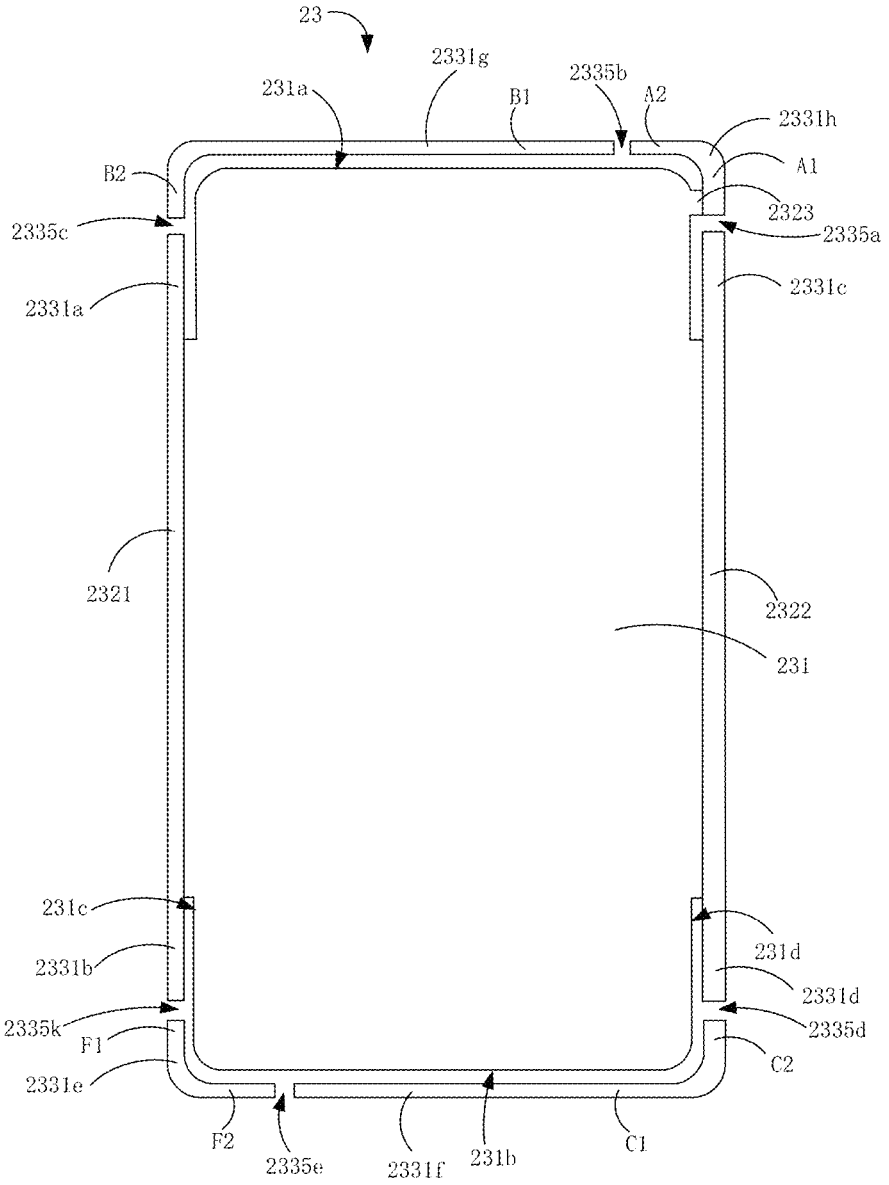
FIG. 4 is a structural diagram of a second embodiment according to the present disclosure.

As shown in FIG. 4, the eighth radiating element 2331*h* is disposed on the first end 231*a*, the fifth radiating element 2331*e* is disposed on one side of the sixth radiating element 2331*f* towards the third end 231*c*. The seventh radiating element 2331*g* is disposed on one side of the eighth radiating element 2331*h* towards the third end 231*c*. The antenna assembly 23 further includes a third metal connecting part 2323. The third metal connecting part 2323 is connected to the fourth end 231*d* and located at one side of the second metal connecting part 2322 towards the first end 231*a*. The third metal connecting part 2323 is connected between the metal main body 231 and the eighth radiating element 2331*h*.

The eighth radiating element 2331*h* includes a first part A1 and a second part A2 connected to the first part A1. The first part A1 is located at the fourth end 231*d* and connected to the third metal connecting part 2323. The second part A2 is located at the first end 231*a*. There is a first gap 2335*a* formed between the eighth radiating element 2331*h* and the third radiating element 2331*c*. The eighth radiating element 2331*h* extends along a direction from the second end 231*b* to the first end 231*a* firstly, and then extends along a direction from the fourth end 231*d* to the third end 231*c*.

The seventh radiating element 2331*g* includes a third part B1 and a fourth part B2 connected to the third part B1. The third part B1 is located at the first end 231*a*. The fourth part B2 is located at the third end 231*c*. There is a second gap 2335*b* formed between the seventh radiating element 2331*g* and the eighth radiating element 2331*h*. There is a third gap 2335*c* formed between the seventh radiating element 2331*g* and the first radiating element 2331*a*. The seventh radiating element 2331*g* extends along a direction from the fourth end 231*d* to the third end 231*c* firstly, and then along a direction from the first end 231*a* to the second end 231*b*.

The sixth radiating element 2331*f* includes a fifth part C1 and a sixth part C2 connected to the fifth part C1. The fifth part C1 is located at the second end 231*b*. The sixth part C2 is located at the fourth end 231*d*. There is a fourth gap 2335*d* formed between the sixth radiating element 2331*f* and the fourth radiating element 2331*d*. There is a fifth gap 2335*e* formed between the sixth radiating element 2331*f* and the fifth radiating element 2331*e*. The sixth radiating element 2331*f* extends along a direction from the first end 231*a* to the second end 231*b* firstly, and then along a direction from the fourth end 231*d* to the third end 231*c*.

The fifth radiating element 2331*e* includes a twelfth part F1 and a thirteenth part F2 connected to the twelfth part F1. The twelfth part F1 is located at the third end 231*c*. The thirteenth part F2 is located at the second end 231*b*. There is an eleventh gap 2335*k* formed between the fifth radiating element 2331*e* and the second radiating element 2331*b*. The fifth radiating element 2331*e* extends along a direction from the first end 231*a* to the second end 231*b* firstly, and then along a direction from the fourth end 231*d* to the third end 231*c*.

Figure 5:
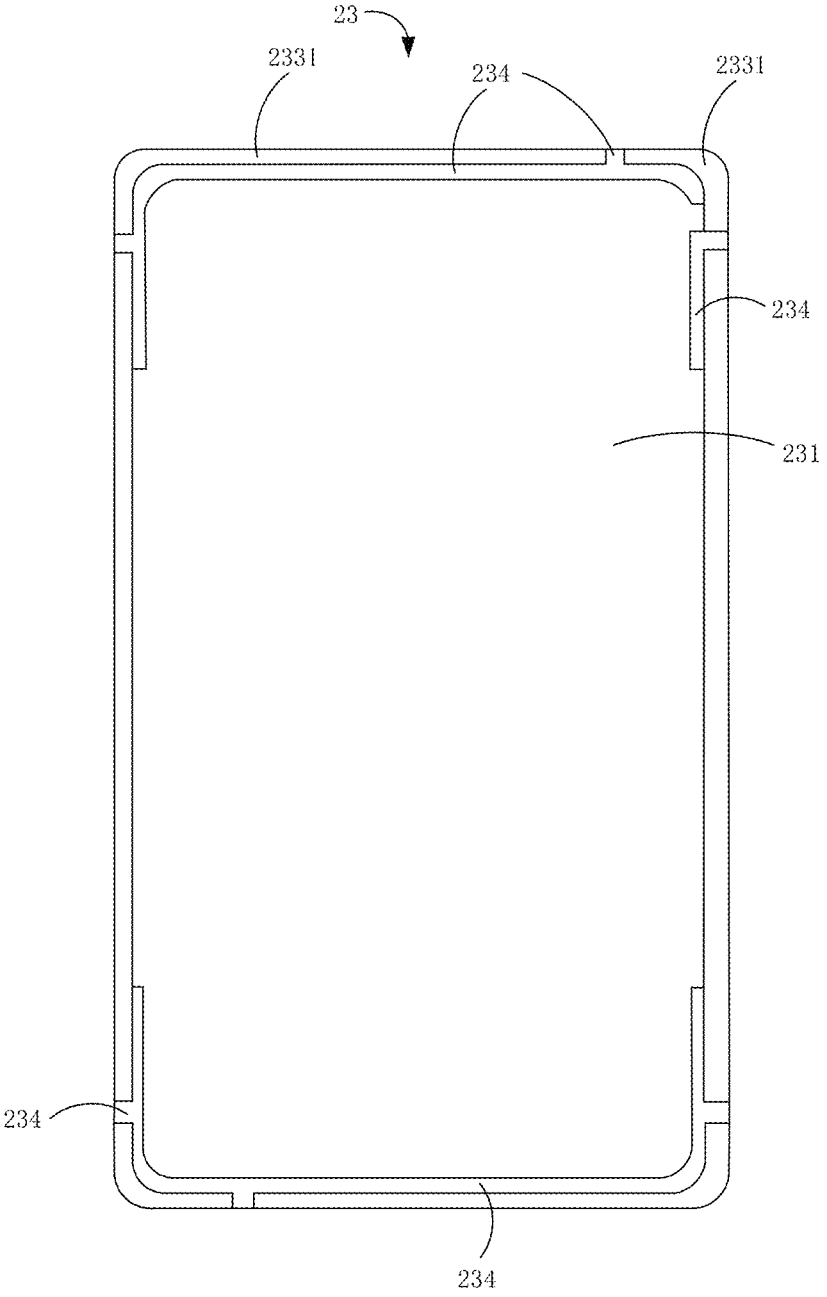
FIG. 5 is a structural diagram of a third embodiment according to the present disclosure.

As shown in FIG. 5, filling parts 234 may be set between every two adjacent radiating elements and between each of the radiating elements and the metal main body 231. The filling parts 234 may be made of non-metallic material to increase connection strength between every two adjacent radiating elements and between each of the radiating elements and the metal main body 231.

Figure 6:
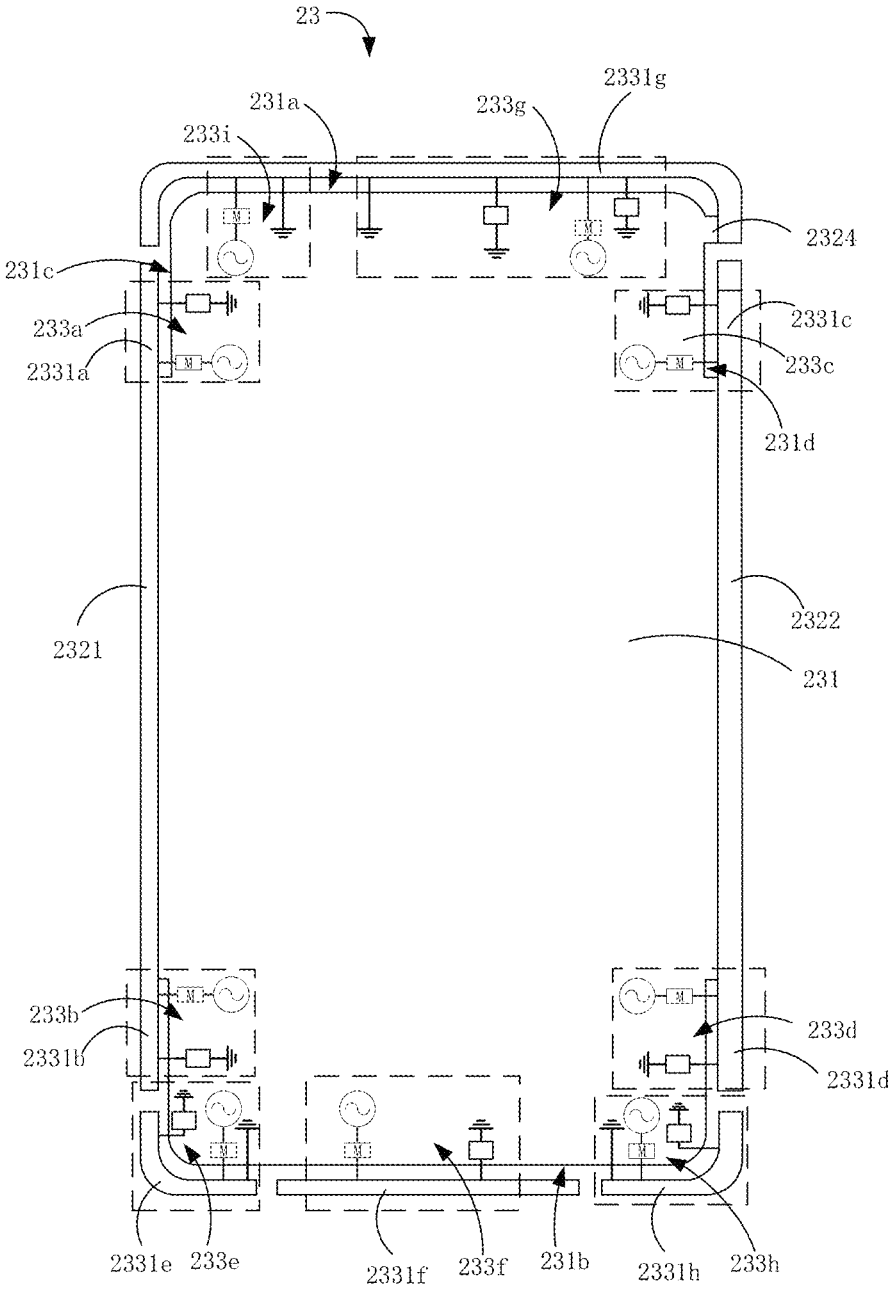
FIG. 6 is a structural diagram of a fourth embodiment according to the present disclosure.
Figure 7:
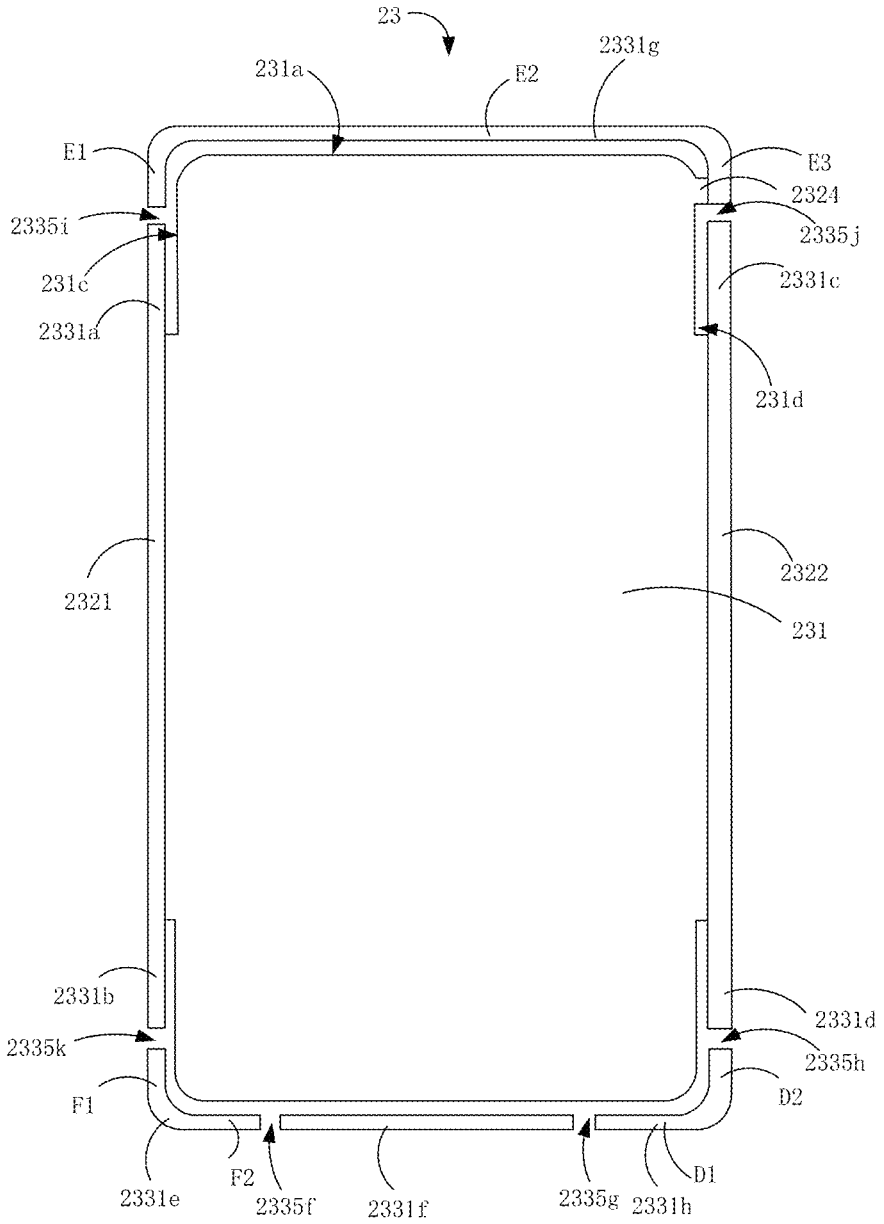
FIG. 7 is a structural diagram of a fifth embodiment according to the present disclosure.

As shown in FIGS. 6-7, when the eighth radiating element 2331*h* is disposed on the second end 231*b*, the fifth radiating element 2331*e* is disposed on one side of the sixth radiating element 2331*f* towards the third end 231*c*. The eighth radiating element 2331*h* is disposed on one side of the sixth radiating 2331*f* towards the fourth end 231*d*.

The sixth radiating element 2331*f* extends along a direction along the fourth end 231*d* to the third end 231*c*. There is a sixth gap 2335*f* formed between the fifth radiating element 2331*e* and the sixth radiating element 2331E There is a seventh gap 2335*g* formed between the seventh radiating element 2331*g* and the sixth radiating element 2331*f*.

The eighth radiating element 2331*h* includes a seventh part D1 and an eighth part D2 connected to the seventh part D1. The seventh part D1 is located at the second end 231*b*. The eighth part D2 is located at the fourth end 231*d*. There is an eighth gap 2335*h* formed between the eighth radiating element 2331*h* and the fourth radiating element 2331*d*. The eighth radiating element extends along a direction from the first end 231*a* to the second end 231*b* firstly, and then extends along a direction from the fourth end 231*d* to the third end 231*c*.

The antenna assembly 23 further includes a fourth metal connecting part 2323. The fourth connecting part 2324 is connected to the second end 231*b* of the metal main body 231 and located at one side of the second metal connecting part 2322 towards the first end 231*a*. The fourth metal connecting part 2324 is connected between the metal main body 231 and the seventh radiating element 2331*g*.

The seventh radiating element 2331*g* includes a ninth part E1, a tenth part E2, and an eleventh part E3, which are sequentially connected. The ninth part E1 is located at the third end 231*c*. The tenth part E2 is located at the first end 231*a*. The eleventh part E3 is located at the fourth end 231*d*. There is a ninth gap 2335*i* formed between the seventh radiating element 2331*g* and the first radiating element 2331*a*. There is a tenth gap 2335*j* formed between the seventh radiating element 2331*g* and the third radiating element 2331*c*. The seventh radiating element 2331*g* extends along a direction from the second end 231*b* to the first end 231*a* firstly, and then extends along a direction from the fourth end 231*d* to the third end 231*c*, and then extends along a direction from the first end 231*a* to the second end 231*b*.

The fifth radiating element 2331*e* includes a twelfth part F1 and a thirteenth part F2 connected to the twelfth part F1. The twelfth part F1 is located at the third end 231*c*. The thirteenth part F2 is located at the second end 231*b*. There is an eleventh gap 2335*k* formed between the fifth radiating element 2331*e* and the second radiating element 2331*b*. The fifth radiating element 2331*e* extends along a direction from the first end 231*a* to the second end 231*b* firstly, and then extends along a direction from the third end 231*c* to the fourth end 231*d*.

Figure 8:
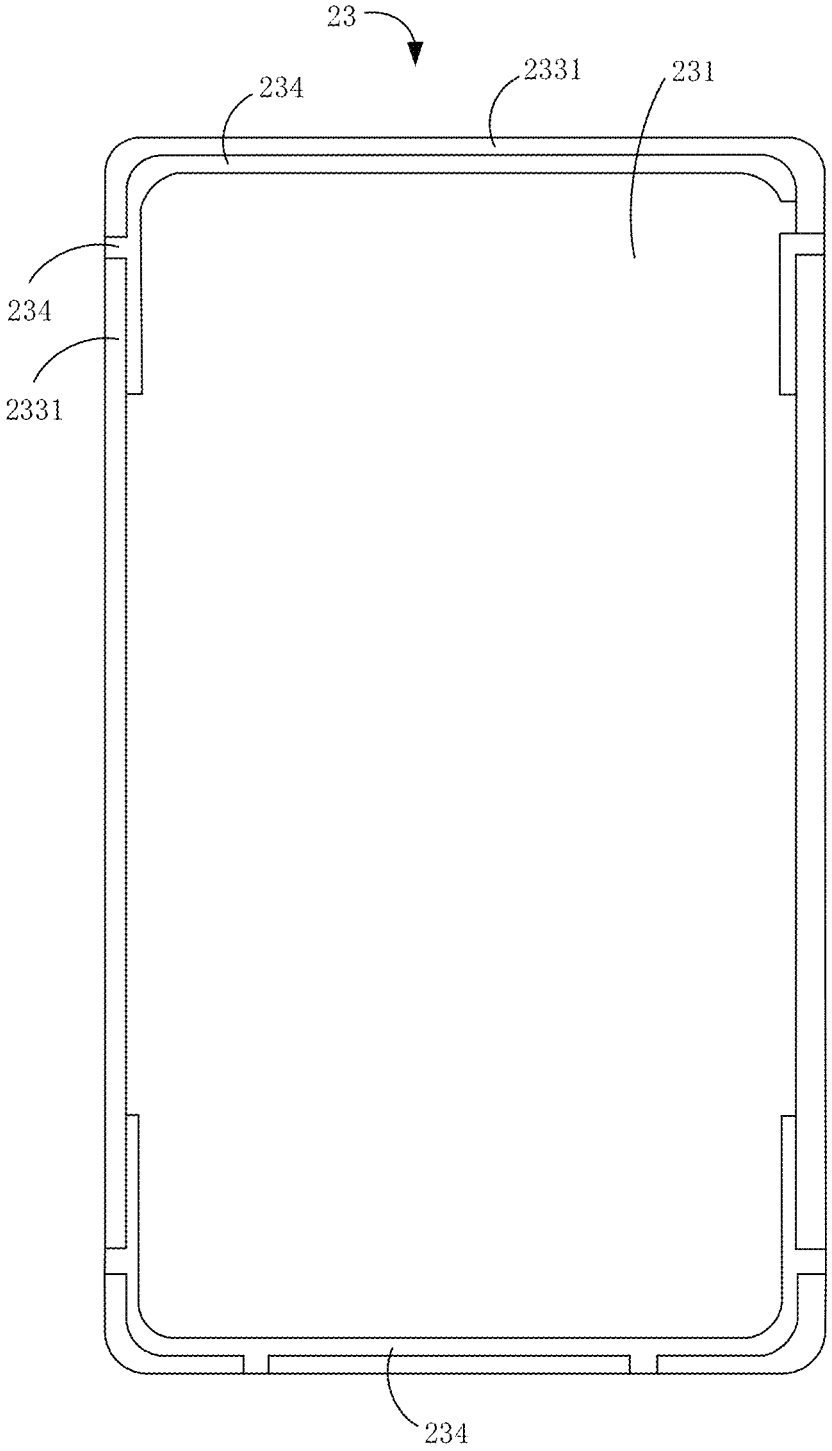
FIG. 8 is a structural diagram of a sixth embodiment according to the present disclosure.

As shown in FIG. 8, the filling parts 234 may be arranged between every two adjacent radiating elements and between each of the radiating elements and the metal main body 231. The filling parts 234 may be made of non-metallic material to increase connection strength between every two adjacent radiating elements and between each of the radiating elements and the metal main body 231.

Figure 9:
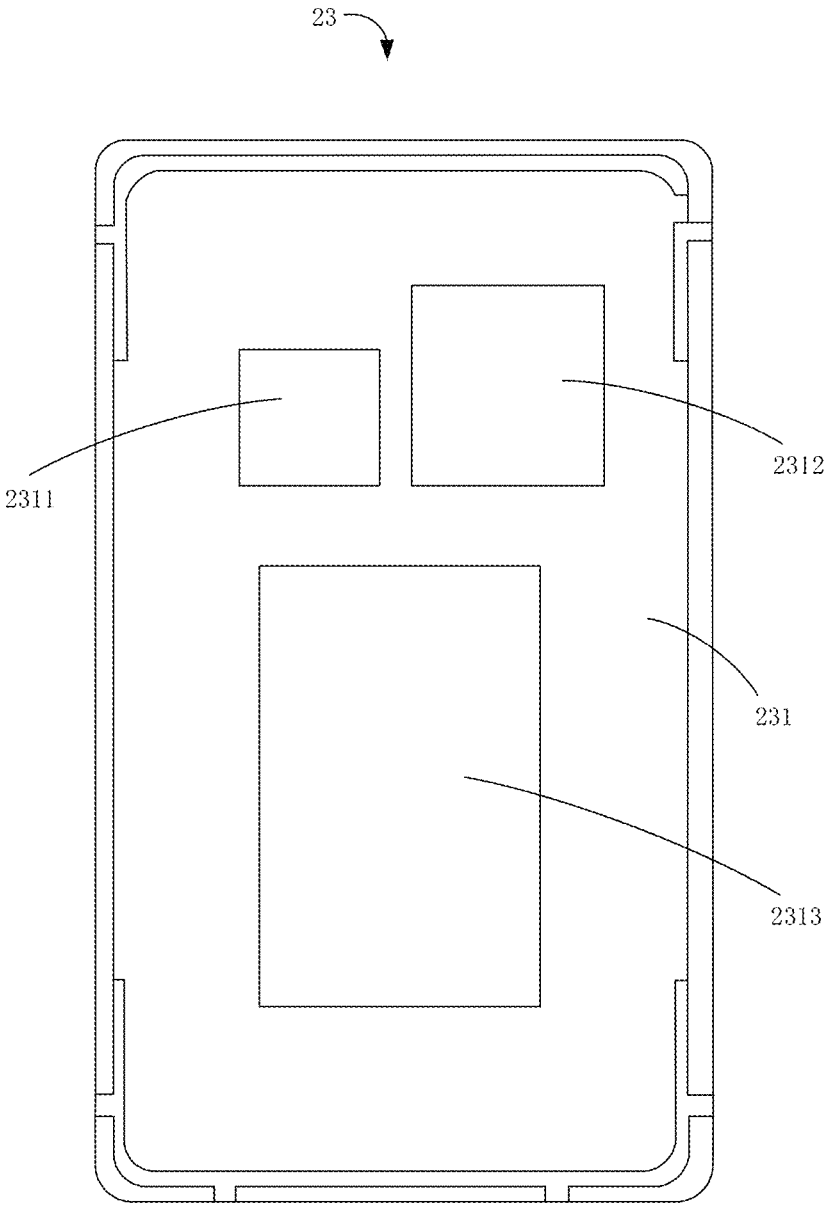
FIG. 9 is a structural diagram of a seventh embodiment according to the present disclosure.

In one embodiment, as shown in FIG. 9, one or at least two of a through hole 2311, a block 2312 and a recess 2313 may be formed in the metal main body 231 by ways of stamping or CNC milling.

The circuit board 31 is installed inside the electronic device 100. The circuit board 31 may be a main board of the electronic device 100. The circuit board 31 may be assembled with one or more of a motor, a microphone, a speaker, an earphone interface, a universal serial bus interface, a camera, a distance sensor, an ambient light sensor, a receiver, and a processor. The earphone interface is disposed corresponding to the headphone hole 105. The microphone is disposed corresponding to the microphone hole 106. The universal serial bus interface is disposed corresponding to the universal serial bus interface hole 107. The speaker is disposed corresponding to the speaker hole 108.

In one embodiment, the circuit board 31 is fixed inside the electronic device 100. In detail, the circuit board 31 may be screwed to the antenna assembly 23 or fixed to the antenna assembly 23 by a fastener. It should be noted that the way of fixing the circuit board 31 to the antenna assembly 23 is not limited to these, other ways such as fixing by a fastener and a screw jointly are also available.

As shown in FIG. 10, the circuit board 31 is provided with the feed 2332 and the matching circuit 2333. The radiating element 2331 is connected to the feed 2332 through the matching circuit 2333.

The battery 32 is installed inside the electronic device 100. The battery 32 is electrically connected to the circuit board 31 to provide power to the electronic device. The back cover 102 may be taken as a battery cover of the battery 32. The back cover 102 covers the battery to protect the battery 32. The back cover 102 covers the battery 32 to keep the battery 32 from damage due to impacting or dropping of the electronic device 100.

The antenna assembly and electronic device provided by the present disclosure includes a metal main body, a first metal connecting part, a second metal connecting part, and eight metal radiating elements arranged on the metal main body. The metal main body includes a first end, a second end opposite to the first end, a third end, and a fourth end opposite to the third end. The first metal connecting part and the second connecting part are respectively connected to the third end and the fourth end of the metal main body. The radiating elements are all spaced from the metal main body. The first radiating element and the second radiating element are connected to the first metal connecting part. The third radiating element and the fourth radiating element are disposed on the second metal connecting part. The fifth radiating element and the sixth radiating element are disposed on the second end. The seventh radiating element is disposed on the first end. The eighth radiating element is disposed on the first end or the second end. The radiating elements are connected to the feeds through the matching circuit board of the electronic device to transmit and receive signal to form an 8×8 5G MIMO (multiple-input multiple-output) antenna, so that the electronic device is provided with multiple antennas to meet high antenna requirements.

The antenna assembly and the electronic device provided by the present disclosure are described in detail, and specific examples are applied in the present disclosure to explain the principles and implementation methods, which is used to help understand the present disclosure only. At the same time, skilled person in the art, according to the idea of the present disclosure, can make changes on the specific embodiment and the scope of application. In summary, the contents of the present disclosure should not be understood as restrictions on the application.

What is claimed is:

1. An antenna assembly, comprising:

a metal main body, wherein the metal main body is in a form of plate, the metal main body comprises a first end, a second end opposite to the first end, a third end, and a fourth end opposite to the third end;

a first metal connecting part and a second metal connecting part, wherein the first metal connecting part and the second metal connecting part are respectively connected to the third end and the fourth end;

a first radiating element, a second radiating element, a third radiating element and a fourth radiating element, wherein the first radiating element, the second radiating element, the third radiating element and the fourth radiating element each are spaced from the metal main body, the first radiating element is connected to one end of the first metal connecting part towards the first end, the second radiating element is connected to another end of the first metal connecting part towards the second end, the third radiating element is connected to one end of the second metal connecting part towards the first end, the fourth radiating element is disposed on the another end of the second metal connecting part towards the second end; and a fifth radiating element, a sixth radiating element, a seventh radiating element, and an eighth radiating element, wherein the fifth radiating element, the sixth radiating element, the seventh radiating element, and the eighth radiating element each are spaced from the metal main body, the fifth radiating element and the sixth radiating element are disposed on the second end, the seventh radiating element is disposed on the first end, and the eighth radiating element is disposed on the first end or the second end;

wherein the antenna assembly is configured to be operated as an 8×8 5G MIMO antenna system;

wherein the antenna assembly further comprises a plurality of frequency band switching modules; and wherein the first radiating element, the second radiating element, the third radiating element, the fourth radiating element, the fifth radiating element, the sixth radiating element, the seventh radiating element, and the eighth radiating element are respectively connected to ground through at least one of the plurality of frequency band switching modules.

2. The antenna assembly as claimed in claim 1, wherein the antenna assembly is configured to support a dual-frequency band, the dual-frequency band comprises both 3.3 GHz to 3.6 GHz channels and 4.8 GHz to 5 GHz channels.

3. The antenna assembly as claimed in claim 1, wherein at least one of the sixth radiating element and the seventh radiating element is multiplexed to support both 4G frequency band and 5G frequency band, the first radiating element, the second radiating element, the third radiating element, the fourth radiating element, the fifth radiating element, and the eighth radiating element are configured to support 5G frequency band only.

4. The antenna assembly as claimed in claim 1, wherein the eighth radiating element is disposed on the first end, the fifth radiating element is located at one side of the sixth radiating element towards the third end, and the seventh radiating element is located at one side of the eighth radiating element towards the third end.

5. The antenna assembly as claimed in claim 4, wherein the antenna assembly further comprises a third metal connecting part, the third metal connecting part is connected to the fourth end and located at one side of the second metal connecting part towards the first end, the third metal connecting part is connected between the metal main body and the eighth radiating element.

6. The antenna assembly as claimed in claim 5, wherein the eighth radiating element comprises a first part and a second part connected with each other, the first part is located at the fourth end and connected to the third metal connecting part, the second part is located at the first end, a first gap is formed between the eighth radiating element and the third radiating element.

7. The antenna assembly as claimed in claim 4, wherein the seventh radiating element comprises a third part and a fourth part connected with each other, the third part is located at the first end, the fourth part is located at the third end, a second gap is formed between the seventh radiating element and the eighth radiating element, and a third gap is formed between the seventh radiating element and the first radiating element.

8. The antenna assembly as claimed in claim 4, wherein the sixth radiating element comprises a fifth part and a sixth part connected with each other, the fifth part is located at the second end, the sixth part is located at the fourth end.

9. The antenna assembly as claimed in claim 8, wherein a fourth gap is formed between the sixth radiating element and the fourth radiating element, and a fifth gap is formed between the sixth radiating element and the fifth radiating element.

10. The antenna assembly as claimed in claim 1, wherein the eighth radiating element is disposed on the second end, the fifth radiating element is located at one side of the sixth radiating element towards the third end, the eighth radiating element is located at one side of the sixth radiating element towards the fourth end.

11. The antenna assembly as claimed in claim 10, wherein a sixth gap is formed between the fifth radiating element and the sixth radiating element, and a seventh gap is formed between the seventh radiating element and the sixth radiating element.

12. The antenna assembly as claimed in claim 10, wherein the sixth radiating element extends along a direction from the fourth end to the third end.

13. The antenna assembly as claimed in claim 10, the eighth radiating element comprises a seventh part and an eighth part connected with each other, the seventh part is located at the second end, the eighth part is located at the fourth end, wherein an eighth gap is formed between the eighth radiating element and the fourth radiating element.

14. The antenna assembly as claimed in claim 10, wherein the antenna assembly further comprises a fourth metal connecting part, the fourth metal connecting part is connected to the second end and located at one side of the second metal connecting part towards the first end, the fourth metal connecting part is connected between the metal main body and the seventh radiating element.

15. An antenna assembly, comprising:

a metal main body, wherein the metal main body is in a form of plate, the metal main body comprises a first end, a second end opposite to the first end, a third end, and a fourth end opposite to the third end;

a first metal connecting part and a second metal connecting part, wherein the first metal connecting part and the second metal connecting part are respectively connected to the third end and the fourth end;

a first radiating element, a second radiating element, a third radiating element and a fourth radiating element, wherein the first radiating element, the second radiating element, the third radiating element and the fourth radiating element each are spaced from the metal main body, the first radiating element is connected to one end of the first metal connecting part towards the first end, the second radiating element is connected to another end of the first metal connecting part towards the second end, the third radiating element is connected to one end of the second metal connecting part towards the first end, the fourth radiating element is disposed on another end of the second metal connecting part towards the second end; and a fifth radiating element, a sixth radiating element, a seventh radiating element, and an eighth radiating element, wherein the fifth radiating element, the sixth radiating element, the seventh radiating element, and the eighth radiating element each are spaced from the metal main body, the fifth radiating element and the sixth radiating element are disposed on the second end, the seventh radiating element is disposed on the first end, and the eighth radiating element is disposed on the metal main body;

wherein the antenna assembly is configured to be operated as an 8×8 5G MIMO antenna system;

wherein the antenna assembly further comprises a plurality of frequency band switching modules, and each of the plurality of frequency band switching modules is configured to achieve switching between two bands of 3.3 GHz to 3.6 GHz and 4.8 GHz to 5 GHz; and wherein the first radiating element, the second radiating element, the third radiating element, the fourth radiating element, the fifth radiating element, the sixth radiating element, the seventh radiating element, and the eighth radiating element are respectively connected to at least one of the plurality of frequency band switching modules.

16. The antenna assembly as claimed in claim 15, wherein at least one of the sixth radiating element and the seventh radiating element is multiplexed to support both 4G frequency band and 5G frequency band, the first radiating element, the second radiating element, the third radiating element, the fourth radiating element, the fifth radiating element, and the eighth radiating element are configured to support 5G frequency band only.

17. The antenna assembly as claimed in claim 15, wherein the eighth radiating element is disposed on the first end, the fifth radiating element is located at one side of the sixth radiating element towards the third end, and the seventh radiating element is located at one side of the eighth radiating element towards the third end.

18. The antenna assembly as claimed in claim 15, wherein the eighth radiating element is disposed on the second end, the fifth radiating element is located at one side of the sixth radiating element towards the third end, the eighth radiating element is located at one side of the sixth radiating element towards the fourth end.

19. An electronic device, comprising:

an antenna assembly, configured to be operated as an 8×8 5G MIMO antenna system, the antenna assembly comprising:

a metal main body, wherein the metal main body is in a form of plate, the metal main body comprises a first end, a second end opposite to the first end, a third end, and a fourth end opposite to the third end;

a first metal connecting part and a second metal connecting part, wherein the first metal connecting part and the second metal connecting part are respectively connected to the third end and the fourth end;

a first radiating element, a second radiating element, a third radiating element and a fourth radiating element, wherein the first radiating element, the second radiating element, the third radiating element and the fourth radiating element each are spaced from the metal main body, the first radiating element is connected to one end of the first metal connecting part towards the first end, the second radiating element is connected to another end of the first metal connecting part towards the second end, the third radiating element is connected to one end of the second metal connecting part towards the first end, the fourth radiating element is disposed on another end of the second metal connecting part towards the second end; and a fifth radiating element, a sixth radiating element, a seventh radiating element, and an eighth radiating element, wherein the fifth radiating element, the sixth radiating element, the seventh radiating element, and the eighth radiating element each are spaced from the metal main body, the fifth radiating element and the sixth radiating element are disposed on the second end, the seventh radiating element is disposed on the first end, and the eighth radiating element is disposed on the first end or the second end; and a circuit board, the circuit board provided with a plurality of feeds, a plurality of matching circuits, and a plurality of frequency band switching modules, wherein the first radiating element, the second radiating element, the third radiating element, the fourth radiating element, the fifth radiating element, the sixth radiating element, the seventh radiating element, and the eighth radiating element are respectively connected to the feeds through at least one of the plurality of matching circuits, and respectively connected to ground through at least one of the plurality of frequency band switching modules;

wherein each of the plurality of frequency band switching modules is configured to achieve switching between two bands of 3.3 GHz to 3.6 GHz and 4.8 GHz to 5 GHz.

20. The electronic device as claimed in claim 19, wherein the first radiating element, the second radiating element, the third radiating element, the fourth radiating element, the fifth radiating element, the sixth radiating element, the seventh radiating element, and the eighth radiating element are each connected to one of the plurality of frequency band switching modules.

* * * * *